US007219594B2

(12) United States Patent
Kugelev et al.

(10) Patent No.: US 7,219,594 B2
(45) Date of Patent: May 22, 2007

(54) COOLANT SYSTEM FOR PISTON AND LINER OF RECIPROCATING PUMPS

(75) Inventors: Vladimir Kugelev, Arlington, TX (US); Mark D. Matzner, Burleson, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 360 days.

(21) Appl. No.: 10/862,216

(22) Filed: Jun. 7, 2004

(65) Prior Publication Data

US 2004/0244576 A1 Dec. 9, 2004

Related U.S. Application Data

(66) Substitute for application No. 60/476,746, filed on Jun. 6, 2003.

(51) Int. Cl.
*F01B 31/08* (2006.01)

(52) U.S. Cl. ..... 92/144; 92/165 R

(58) Field of Classification Search ..... 92/86, 92/144, 163, 165 R, 166, 172
See application file for complete search history.

(56) References Cited

U.S. PATENT DOCUMENTS 1,537,851 A * 5/1925 Maingault ..... 92/144
2,250,419 A * 7/1941 Johnston et al. ..... 92/144
2,439,958 A * 4/1948 Anderson ..... 92/144
3,394,633 A * 7/1968 Payne et al. ..... 92/144
3,782,123 A * 1/1974 Muschalek, Jr. ..... 92/13
6,315,537 B1 11/2001 Helbing et al.
2004/0244576 A1 12/2004 Kugelev et al.

FOREIGN PATENT DOCUMENTS

GB 235939 6/1925

* cited by examiner

*Primary Examiner*—Igor Kershteyn
(74) *Attorney, Agent, or Firm*—Bracewell & Giuliani LLP

(57) ABSTRACT

A reciprocating pump assembly includes piston rod that is movable and reciprocates in order to pump a fluid. The piston rod has a piston portion at an end that stokes within a piston chamber. The pump assembly also includes a piston rod sleeve that houses the piston rod. The piston rod sleeve does not reciprocate with the piston rod. Thus, the piston rod sleeve remains stationary. The piston rod sleeve defines and annulus between the piston rod and the piston rod sleeve. The pump assembly has a fluid line that leads into the annulus. The fluid line delivers coolant to the annulus. The pump assembly also includes a flow passage. The flow passage has an inlet in fluid communication with the annulus for receiving the coolant. The passage also has an outlet in fluid communication with the piston chamber for delivering the coolant.

20 Claims, 4 Drawing Sheets

COOLANT SYSTEM FOR PISTON AND LINER OF RECIPROCATING PUMPS

RELATED APPLICATIONS

This nonprovisional patent application claims the benefit of co-pending, provisional patent application U.S. Ser. No. 60/476,746, filed on Jun. 6, 2003, which is hereby incorporated by reference in its entirety.

BACKGROUND OF THE INVENTION

1. Field of the Invention

The present invention relates generally to reciprocating pumps, more specifically to a coolant system for the piston and liner of the reciprocating pumps.

2. Background of the Invention

In oil field operations, reciprocating pumps are often used for various purposes. Some reciprocating pumps, generally known as "mud pumps," are typically used for well drilling operations. During operation, the pistons and liners of the pumps generate large amounts of heat due to friction. It is desirous to cool the liners and pistons in order to extend their operation lives, which in turn increases overall efficiency and reduces down-time for maintenance.

Prior systems for cooling pistons and liners includes various coolant injector systems. For example, in one system, a coolant line or hose is physically coupled to the piston rod with a the hose feeding into the piston. The coolant hose moves with the piston rod during operations. The hose in this system typically has a short life due to wear associated with moving with the piston rod. Another system includes a hose that connects to an outer surface of the piston rod that transmits the coolant through the piston rod to a sprayer located in the piston rod adjacent the piston. The hose in this assembly also has problems with wear because the hose connects to and reciprocates with the piston rod.

SUMMARY OF THE INVENTION

In this invention, a reciprocating pump assembly includes piston rod that is movable and reciprocates in order to pump a fluid. The piston rod has a piston portion at an end that stokes within a piston chamber. The pump assembly also includes a piston rod sleeve that houses the piston rod. The piston rod sleeve does not reciprocate with the piston rod, so the piston rod sleeve remains stationary. The piston rod sleeve also defines and annulus between the piston rod and the piston rod sleeve. The pump assembly has a fluid line that leads into the annulus. The fluid line delivers coolant to the annulus. The pump assembly also includes a flow passage. The flow passage has an inlet in fluid communication with the annulus for receiving the coolant. The passage also has an outlet in fluid communication with the piston chamber for delivering the coolant.

The flow passage of the pump assembly may be located within the piston rod. As such, the coolant flows through an interior of the piston rod between the inlet and outlet of the flow passage. The pump assembly can also include a fluid sprayer. The sprayer is typically located at the outlet of the flow passage in order to deliver a spray of fluid into the piston chamber.

The piston rod can include an outer shell that has an inner circumference. The piston rod can also include a pony rod that is located within the outer shell and has an outer circumference that is less than inner circumference of the outer shell. The pony rod and the outer shell define a clearance between the inner surface of the outer shell and the outer surface of the pony rod. The clearance can be a portion of the flow passage for carrying the coolant from the annulus and the piston chamber.

DETAILED DESCRIPTION OF THE PREFERRED EMBODIMENT

Figure 1:
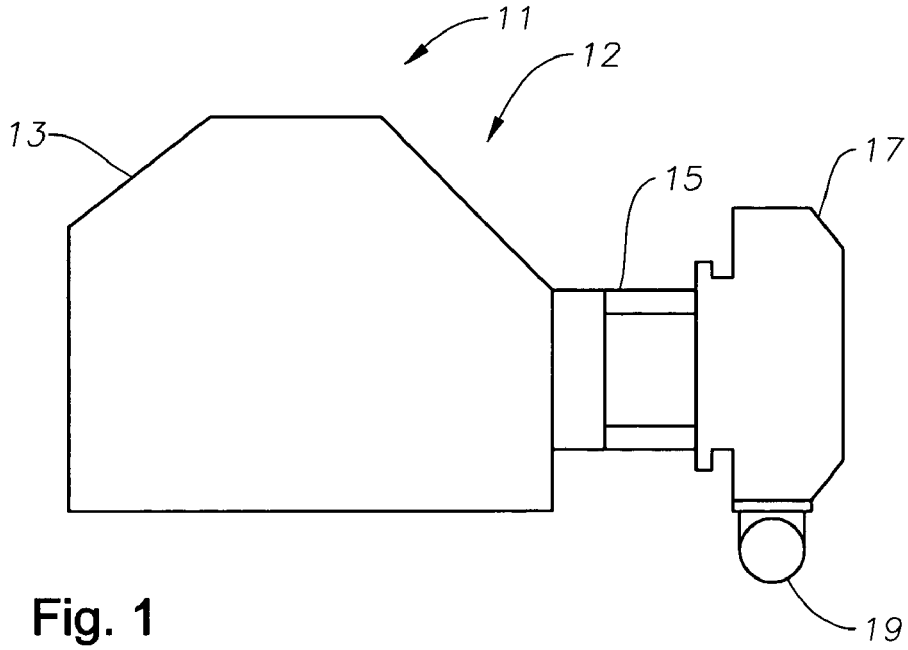
FIG. 1 is a schematic elevational view of a reciprocating pump assembly constructed in accordance with this invention.

Referring to FIG. 1, a reciprocating pump 11 includes a crankshaft housing 13 that comprises a majority of the outer surface of reciprocating pump 11 shown in FIG. 1. A piston rod housing 15 attaches to a side of crankshaft housing 13 and extends to a piston chamber or cylinder 17. Cylinder 17 preferably includes a fluid inlet 19 and a fluid outlet 21 (FIG. 2).

Figure 2:
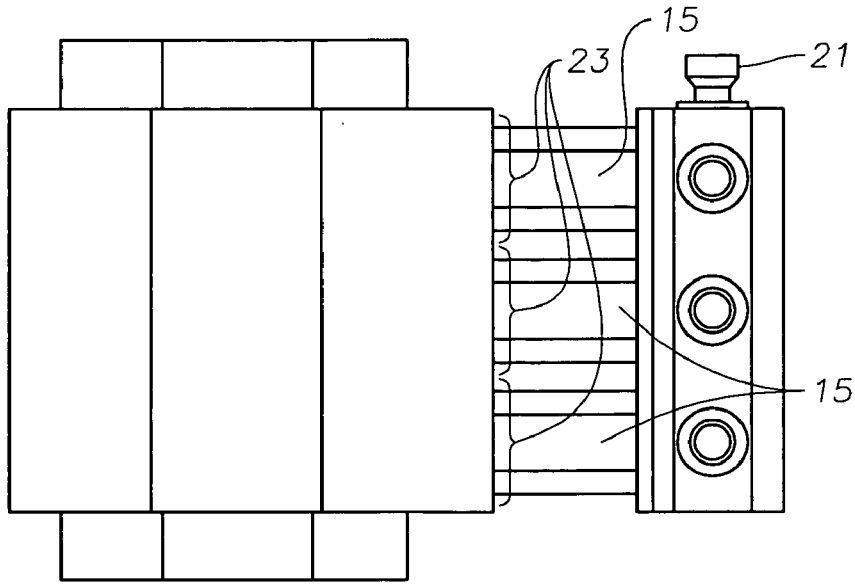
FIG. 2 is a top plan schematic view of the reciprocating pump assembly shown in FIG. 1.

Referring to FIG. 2, piston rod housing 15 is segmented into three portions, each portion comprising a piston throw 23. Reciprocating pump 11 as shown in FIG. 2 has three piston throws 23, which is commonly know as a triplex, but could also be segmented for five piston throws 23, which is commonly known as a quintuplex pump. The description focuses on a triplex pump, but as will be readily apparent to those skilled in the art, the features and aspects described are easily applicable for pumps with various numbers of piston throws 23. Each piston throw 23 houses a piston rod 33 (FIG. 3) extending toward cylinder 17. As shown in FIG. 2, each piston throw 23 extends in the same longitudinal direction from crankshaft housing 13.

Figure 3:
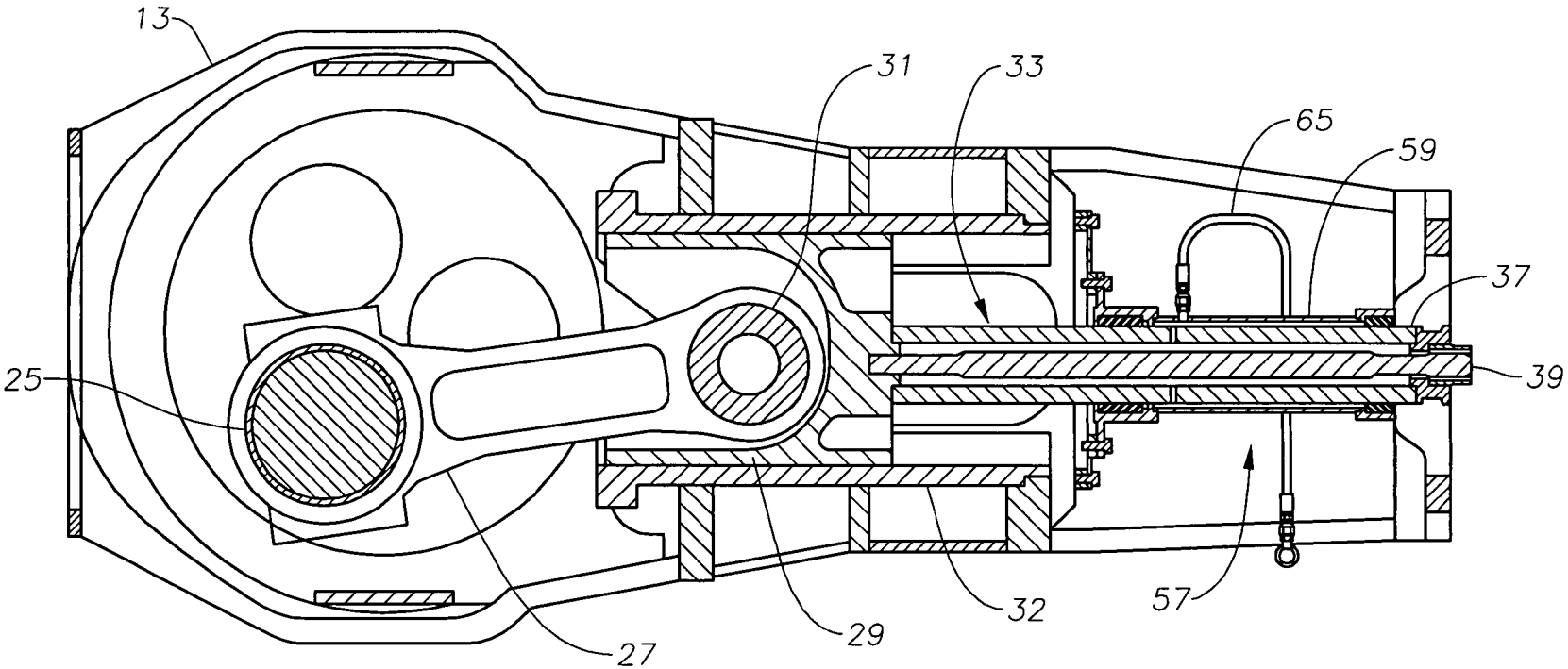
FIG. 3 is a sectional view of a portion of the pump assembly shown in FIG. 1.

Referring to FIG. 3, a portion of reciprocating pump 11 housed within crankshaft housing 13 is shown. Crankshaft housing 13 houses a crankshaft 25, which is typically connected to a motor (not shown). The motor (not shown) rotates crankshaft 25 in order to drive reciprocating pump 11. In the preferred embodiment, crankshaft 25 is cammed so that fluid is pumped from each piston throw 23 at alternating times. As is readily appreciable by those skilled in the art, alternating the cycles of pumping fluid from each of cylinders 17 helps minimize the primary, secondary, and tertiary (et al.) forces associated with reciprocating pump 11. In the preferred embodiment, a connector rod 27 includes an end that connects to crankshaft 25 and another end that engages a crosshead 29. Connector rod 27 connects to crosshead 29 through a crosshead pin 31, which holds connector rod 27 longitudinally relative to crosshead 29. Connector rod 27 pivots about crosshead pin 31 as crankshaft 25 rotates with the other end of connector rod 27. A piston rod 33 extends from crosshead 29 in a longitudinally opposite direction from crankshaft 25. Connector rod 27 and crosshead 29 convert rotational movement of crankshaft 25 into longitudinal movement of piston rod 33. A crosshead housing 32, located in crankshaft housing 13, extends longitudinally away from crankshaft 25. In the preferred embodiment, crosshead housing 32 guides crosshead 29 as crosshead 29 reciprocates longitudinally relative to crankshaft 25.

Figure 4:
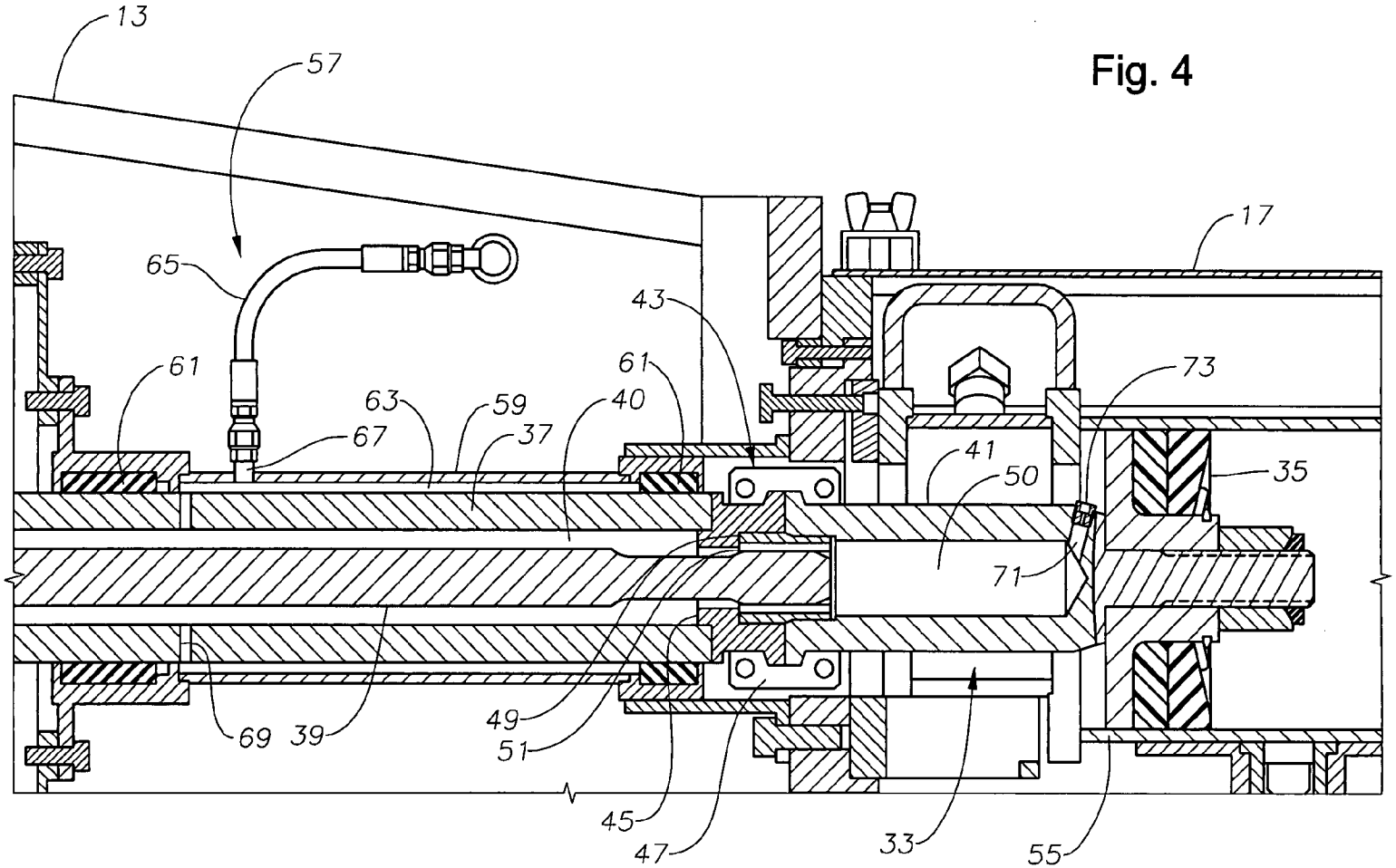
FIG. 4 is an enlarged sectional view of a portion of the pump assembly shown in FIG. 1.

Referring to FIG. 4, a piston portion 35 connects to piston rod 33 for pumping the fluid passing through reciprocating pump 11. As illustrated in FIG. 4, piston portion 35 is a piston. Cylinder 17 (FIG. 1) connects to the end of piston rod housing 15 extending away from crankshaft housing 13 (FIG. 1). Cylinder 17 typically includes a cylinder chamber, which is where the fluid being pumped by reciprocating pump 11 is pressurized by piston 35. Piston rod 33 preferably includes an outer shell or outer casing 37 and a pony rod 39, that are each connected to and extending away from crosshead 29. Pony rod 39 is preferably a solid shaft having a threaded profile toward the end extending away from crosshead 29. Outer casing 37 preferably encloses a substantial portion of pony rod 39, thereby defining a rod annulus 40 in the area between pony rod 39 and outer casing 37.

Piston rod 33 also preferably includes a tubular extension or extension rod 41 connected to the ends of pony rod 39 and outer casing 37. Extension rod 41 extends longitudinally away from crankshaft 25 (FIG. 3) to connect piston rod 33 with piston 35. Piston rod 33 also preferably includes a rod clamp assembly 43 that connects extension rod 41 with the ends of outer casing 37 and pony rod 39. In the preferred embodiment, rod clamp assembly 43 includes an intermediate casing 45 that abuts an end portion of outer casing 37 and receives a portion of pony rod 39. A portion of intermediate casing 45 is flared so that the outer diameter of intermediate casing 45 located toward the end extending away from crankshaft 25 is greater than other portions of intermediate casing 45. Extension rod 41 also has a flared portion located toward the end of extension rod 41 that is being connected to pony rod 39 and outer casing 37.

The flared portions of intermediate casing 45 and extension rod 41 abut and are held relative to each other by an outer clamp 47. Outer clamp 47 encloses the interface of intermediate casing 45 and extension rod 41. Outer clamp 47 has a recess portion which surrounds the flared portions of extension rod 41 and intermediate casing 45. Therefore, as outer casing 37 reciprocates longitudinally toward and away from crankshaft 25, extension rod 41 must also reciprocate toward and away crankshaft 25.

In the preferred embodiment, extension rod 41 is a tubular member which also receives and encloses a portion of pony rod 39. Preferably an inner sleeve 49, having a threaded profile that matingly engages with the threaded profile located toward the end of pony rod 39 extending away from crankshaft 25, is positioned at the interface of intermediate casing 45 and extension rod 41. Intermediate casing 45 preferably includes an inner bore which receives a portion of inner sleeve 49 and prevents inner sleeve 49 from moving relative to intermediate casing 45 closer to crankshaft 25. Extension rod 41 also preferably has an inner bore which receives a portion of inner sleeve 49, which prevents inner sleeve 49 from moving relative to extension rod 41. In the preferred embodiment, an extension rod annulus 50 is defined between piston 35, inner sleeve 49, the end of pony rod 39 extending away from crankshaft 25, and the interior of extension rod 41. Piston 35 connects to the end of extension rod 41 extending away from rod clamp assembly 45. In the preferred embodiment, a plurality of passages 51 extend longitudinally through inner sleeve 49, between rod annulus 40 and extension rod annulus 50, around the threaded portion of pony rod 39 so that rod annulus 40 and extension annulus 50 are in fluid communication through rod clamp assembly 43.

A piston liner 55 adjoins to an interior surface of cylinder 17. In the preferred embodiment, piston liner 55 is in fluid communication with an interior portion of cylinder 17 and thereby defining a pumping chamber of reciprocating pump assembly 11. Piston 35 slidingly engages piston liner 55 as piston 35 reciprocates longitudinally toward and away from crankshaft 25. Reciprocating piston 35 within piston liner 55 causes the volume of the pumping chamber to increase and decrease as piston 35 reciprocates longitudinally toward and away from crankshaft 25, thereby positively displacing the fluid being pumped through reciprocating pump 11.

Piston 35 typically experiences wear from the heat created by sliding engagement of piston liner 55 during normal pumping operations. Typically the fluid being pumped through the pumping chamber of reciprocating pump 11 helps to lubricate and cool the portion of piston liner 55 on the cylinder side of piston 35. A coolant assembly 57 provides coolant to the crankshaft 25 side of piston 35 to prevent excessive heat and wear between piston 35 and piston liner 55. In the preferred embodiment, coolant assembly 57 preferably includes a piston rod sleeve or coolant sleeve 59 extending between crosshead housing 32 and the portion of crankshaft housing 13 that engages piston rod housing 15. Coolant sleeve 59 preferably encloses outing casing 37 of piston rod 33 and is stationary. Seals 61 preferably seal the end of coolant sleeve 59 adjacent crosshead housing 32 and the end of connector sleeve 59 adjacent rod clamp assembly 43. The interior surface of coolant sleeve 59 and seals 61 thereby define a sleeve annulus 63 surrounding outer casing 37 of piston rod 33. In the preferred embodiment, a fluid line or injector hose 65 injects a coolant into sleeve annulus 63 through a sleeve port 67 extending through a side of sleeve 59. Injector hose 65 typically extends away from lubricator sleeve 59 to an outer surface of crankshaft housing 13 to receive the coolant from a coolant source (not shown).

In the preferred embodiment, seal 61 located adjacent crosshead housing 32 is placed a predetermined distance from seal 61 located adjacent the end of crankshaft housing 13 extending away from crankshaft 25, such that the distance between seals 61 is greater than or substantially equal to the length of the stroke of piston 35. In the preferred embodiment, an outer shell or casing port 69 extends through a side of outer casing 37 of piston rod 33. Rod annulus 40 and sleeve annulus 63 are in full communication through outer casing port 69. Rod annulus 40 and sleeve annulus 63 are in fluid communication throughout the entire stroke length of the piston rod. In the preferred embodiment, outer casing port 69 is formed on a portion of outer casing 37 such that outer casing port 69 is always substantially between seals 61 during operations of reciprocating pump 11. Therefore, coolant from injector hose 65 that accumulates in sleeve annulus 63 can readily communicate through outer casing port 69 into rod annulus 40 while piston rod 33 reciprocates toward and away from crankshaft 25. In the preferred embodiment, the coolant that communicates from sleeve annulus 63 through outer casing port 69 travels along pony rod 33 toward passages 51 and inner sleeve 49. The coolant communicates through passages 51 from rod annulus 40 and into extension annulus 50 toward piston 35.

Figure 5:
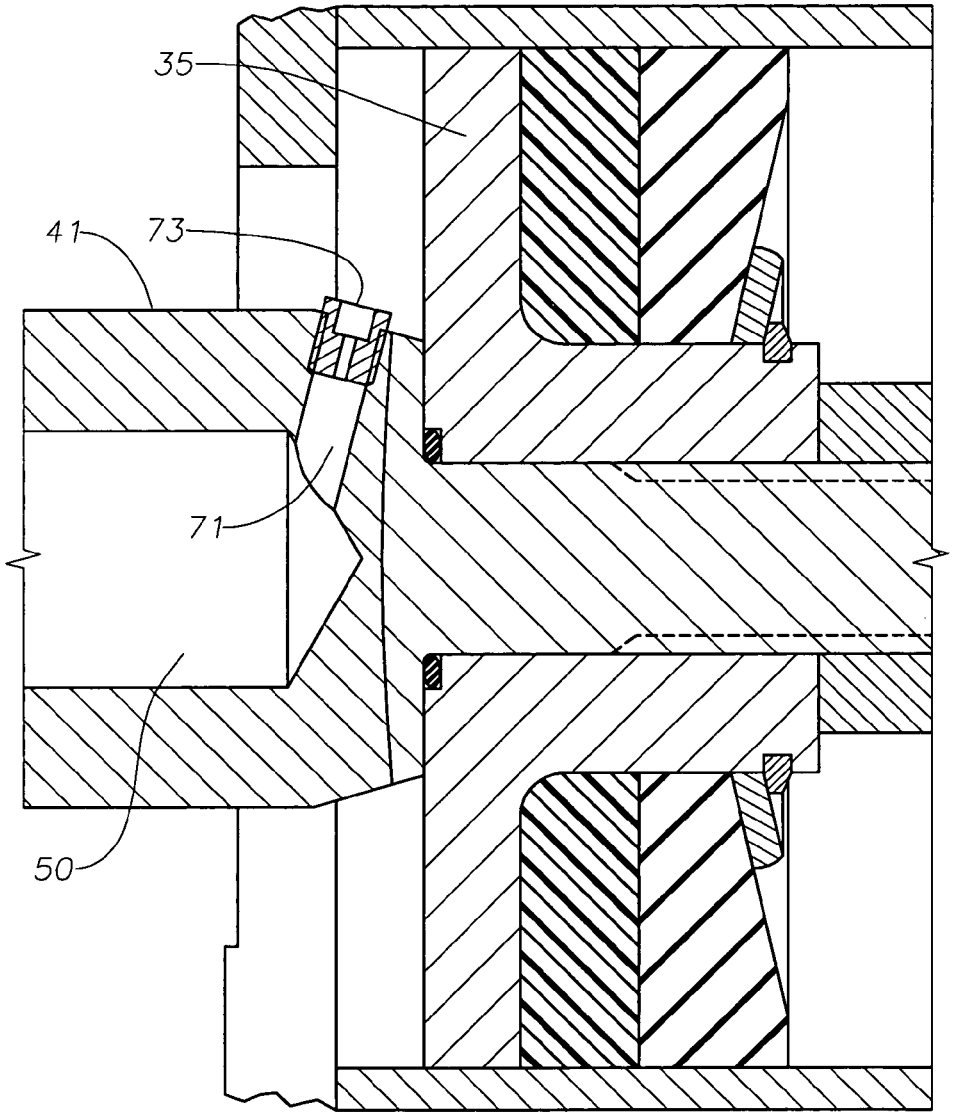
FIG. 5 is an enlarged portion of the portion of the pump assembly shown in FIG. 4.

Referring to FIGS. 4 and 5, a spray port 71 is formed in extension rod 41 at a position adjacent piston 35. An injector sprayer 73 is preferable located within a spray port 71. Spray port 71 and injector sprayer 73 are preferably angled so that coolant is sprayed along the crankshaft 25 (FIG. 3) side of piston 35 and piston liner 55. Therefore, in the preferred embodiment the coolant flows from sleeve annulus 63 through a continues passage that includes outer casing port 69, rod annulus 40, passages 51 within clamp assembly 43, extension annulus 50 and spray port 71. This flow passage is merely a preferred embodiment, and as will be readily appreciated by those skilled in the art, this passageway is subject change due to slight variations.

Coolant assembly 57 advantageously provides coolant to the crankshaft 25 side of piston 35 and piston liner 55. This reduces excessive heat and wear between piston 35 and piston liner 55. Coolant assembly 57 also advantageously provides and assembly in which fluid line or fluid hose 65 remains stationary during pump operations. Therefore, hose 65 is not subject to the reciprocating movements that cause wear and failure in previous cooling assemblies. Accordingly, pumping operations can continue for longer periods of time between replacement of the fluid hose 65.

While the invention has been shown in only one of its forms, it should be apparent to those skilled in the art that it is not so limited, but is susceptible to various changes without departing from the scope of the invention. For example, injector hose 65 can extend from lubricator sleeve 59 toward a side portion of crankshaft housing 13 as shown in FIG. 4 or toward a lower portion of crankshaft housing 13 as shown in FIG. 3 to receive coolant fluid from a coolant source (not shown). A further example that can be readily appreciated by those still in the art, while the invention has only been shown with respect to mud pumps, the same lubrication system can also be easily adapted for service pumps using a piston attached to a pony rod.

That claimed is:

1. A reciprocating pump assembly, comprising:

a housing having a piston chamber with a working fluid inlet and a working fluid outlet;

a crankshaft rotatably driven in the housing;

a connector rod having a first end mounted to the crankshaft for rotation therewith and a second end;

a movable piston rod pivotally mounted to the second end of the connector rod, the piston rod having a piston portion at an end that stokes linearly within the piston chamber, the piston portion having a working fluid side for pumping out the outlet working fluid entering the inlet;

a stationary piston rod sleeve that houses the piston rod and defines an annulus;

a cooling fluid line leading into the annulus; and a cooling fluid flow passage having an inlet in fluid communication with the annulus and an outlet in fluid communication with the piston chamber on a side of the piston portion opposite the working fluid side for cooling the piston portion.

2. The reciprocating pump assembly of claim 1, wherein the cooling fluid flow passage is located with the piston rod.

3. The reciprocating pump assembly of claim 1, further comprising a fluid sprayer at the outlet of the cooling fluid flow passage in order to deliver a spray of cooling fluid.

4. The reciprocating pump assembly of claim 1, wherein the cooling fluid flow passage extends through a portion of the piston rod and the outlet is located adjacent the piston portion of the piston rod.

5. The reciprocating pump assembly of claim 1, wherein:

the piston rod further comprises an outer shell having an inner circumference and a pony rod located within the outer shell that has an outer circumference that is less than inner circumference of the outer shell, defining a clearance; and the cooling fluid flow passage includes the clearance between the outer shell and the pony rod.

6. The reciprocating pump assembly of claim 1, wherein the piston rod further comprises:

a first tubular member and a pony rod carried within the first tubular member, the pony rod having an outer circumference that is less than the first tubular member thereby defining a clearance that is part of the cooling fluid flow passage; and a second tubular member connected to an end of the pony rod and an end of the first tubular member, the second tubular member extending the length of the piston rod and having an extension annulus that is also part of the cooling fluid flow passage.

7. A reciprocating pump assembly, comprising:

a movable piston rod having a piston at an end that strokes within a piston chamber, the piston rod having an outer shell with a tubular cross section and a pony rod extending therethrough, the outer shell and the pony rod defining a clearance between the outer surface of the pony rod and the inner surface of the outer shell, the piston rod also having a tubular extension attached to the outer shell and the pony rod, the tubular extension defining an extension annulus;

a stationary piston rod sleeve that houses each of the piston rod and the pony rod and defines a sleeve annulus;

a fluid line leading into the sleeve annulus; and a flow passage comprising the clearance between the pony rod and outer shell and the extension annulus, the flow passage having an inlet located in the clearance that is in fluid communication with the sleeve annulus and an outlet located in the tubular extension that is in fluid communication with the piston chamber.

8. The reciprocating pump assembly of claim 7, wherein the flow passage further comprises an outer shell port extending through a side of the outer shell to the sleeve annulus.

9. The reciprocating pump assembly of claim 8, wherein the outer shell port extends between the sleeve annulus and the clearance defined by the pony rod and the outer shell throughout the entire stroke of the piston rod such that the flow passage is in continuous fluid communication with the sleeve annulus.

10. The reciprocating pump assembly of claim 7, wherein the outlet of the flow passage comprises an outlet port extending through a side of the tubular extension to the piston chamber.

11. The reciprocating pump assembly of claim 7, wherein the flow passage further comprises a connection passage extending between the extension annulus and the clearance defined by the pony rod and the outer shell.

12. The reciprocating pump assembly of claim 7, wherein the sleeve annulus further comprises a sleeve port extending through a side of the stationary piston rod sleeve.

13. The reciprocating pump assembly of claim 7, further comprising a coolant sprayer located in the flow passage outlet to spray coolant on the piston and an interior surface of the piston chamber.

14. The reciprocating pump assembly of claim 7, wherein the piston rod further comprises an intermediate casing located between the tubular extension and the outer casing, the intermediate casing housing a portion of the pony rod extending beyond the outer shell.

15. The reciprocating pump assembly of claim 14, wherein the flow passage further comprises a connection passage extending between the extension annulus and the clearance defined by the pony rod and the outer shell, and a portion of the connection passage extends between the pony rod and the intermediate casing.

16. A method of cooling a portion of a reciprocating pump, comprising:

providing a movable piston rod with a piston portion, the piston rod having a flow passage extending therethrough with an outlet in fluid communication with a piston chamber;

housing the piston rod within a piston rod sleeve that defines an annulus;

connecting a fluid line to the piston rod sleeve so the fluid line is in fluid communication with the annulus;

reciprocating the piston rod within the piston rod sleeve; and transmitting a coolant from the fluid line to the outlet of the flow passage.

17. The method of claim 16, further comprising providing a coolant sprayer located within the outlet of the flow passage and spraying the cooling into the piston chamber.

18. The method of claim 16, wherein reciprocating the piston rod defines a stroke length, and the coolant is transmitted from the fluid line to the outlet of the flow passage while the piston rod reciprocates through the entire stroke length.

19. The method of claim 16, wherein the outer piston sleeve and the fluid line are stationary while the piston rod reciprocates within the piston rod sleeve.

20. The method of claim 16, further comprising spraying the coolant onto a side of the piston and a liner located on the interior surface of piston chamber.

* * * * *